US012188322B2

(12) United States Patent
O'Dell et al.

(10) Patent No.: US 12,188,322 B2
(45) Date of Patent: Jan. 7, 2025

(54) LOCKDOWN RING USING A SELF-LOCKING WEDGE

(71) Applicant: Baker Hughes Oilfield Operations LLC, Houston, TX (US)

(72) Inventors: Kevin O'Dell, Houston, TX (US); Samuel Cheng, Houston, TX (US); Keith Adams, Katy, TX (US); Wei He, Houston, TX (US); Eugene Borak, Houston, TX (US)

(73) Assignee: Baker Hughes Oilfield Operations LLC, Houston, TX (US)

( * ) Notice: Subject to any disclaimer, the term of this patent is extended or adjusted under 35 U.S.C. 154(b) by 0 days.

(21) Appl. No.: 17/396,239

(22) Filed: Aug. 6, 2021

(65) Prior Publication Data

US 2023/0039692 A1 Feb. 9, 2023

(51) Int. Cl.
*E21B 33/03* (2006.01)

(52) U.S. Cl.
CPC ..... *E21B 33/03* (2013.01)

(58) Field of Classification Search
CPC ..... E21B 33/03
See application file for complete search history.

(56) References Cited

U.S. PATENT DOCUMENTS 172,102 A * 1/1876 Ellis ..... F04B 53/164 138/147
4,496,172 A * 1/1985 Walker ..... E21B 33/038 285/321
4,790,572 A 12/1988 Slyker
5,178,216 A 1/1993 Giroux
5,307,879 A 5/1994 Kent
5,327,965 A 7/1994 Stephen
8,960,276 B2 2/2015 Lang
9,945,201 B2 4/2018 Tamosaitis
2005/0242519 A1 11/2005 Koleilat
2011/0005774 A1* 1/2011 Sinnott ..... E21B 33/0422 166/380
2014/0183824 A1* 7/2014 Benson ..... E21B 33/04 277/339
2016/0298410 A1* 10/2016 Tamosaitis ..... E21B 33/02
2021/0095535 A1* 4/2021 Cheng ..... E21B 23/01

FOREIGN PATENT DOCUMENTS

EP 0261909 3/1988

OTHER PUBLICATIONS

Dril-Quip, "Subsea Tie-Back Systems," 2014, 12 pages.
International Search Report and Written Opinion mailed Sep. 8, 2022 in corresponding PCT Application No. PCT/US22/38772.

* cited by examiner

*Primary Examiner* — D. Andrews
*Assistant Examiner* — Ronald R Runyan
(74) *Attorney, Agent, or Firm* — Baker Hughes Patent Organization

(57) ABSTRACT

A wedge to be used with a lockdown ring is disclosed. The lockdown ring is to be used with a wellhead. The wedge is enabled to engage a separation in the lockdown ring. The wedge includes a stopping feature to enable the wedge to be in one of a plurality of positions within the separation in the lockdown ring.

20 Claims, 7 Drawing Sheets

LOCKDOWN RING USING A SELF-LOCKING WEDGE

BACKGROUND

1. Field of Invention

This invention relates in general to equipment used in a wellhead, and in particular, to a reusable retention system to be used with a lockdown ring for retention of features in a wellhead.

2. Description of the Prior Art

Hangers, such as casing and/or tubing hangers, are used in offshore and onshore oil and gas rigs for various purposes. In an example, the casing hanger forms part of the wellhead and is lowered into the wellbore to an appropriate depth and rested on a shoulder or load ring inside the wellhead. The casing hanger may also be suspended in its position. The casing hanger may be provided for hanging the casing pipe. The casing hangers may be provided in a stack configuration. The casing may have subsequently smaller internal diameters (IDs) to isolate different zones within the wellbore. The annulus between each casing hanger and housing is sealed. Such a seal provides a pressure and temperature-resistant seal between the hanger and the wellhead. The seal, however, must hold pressure from different directions. Further, the suspension of the actuator ring or use of shoulders on the hanger may limit placement options and accuracy of placement of the seal.

SUMMARY

A system for a lockdown ring to be used with a wellhead is disclosed. In at least one embodiment, the system includes a wedge to be associated with a separation in the lockdown ring. A stopping feature is associated with the wedge. The stopping feature is to enable the wedge to be in one of a number of positions within the separation in the lockdown ring.

In at least one embodiment, a wedge to be used with a lockdown ring is disclosed. The lockdown ring to be used with a wellhead. The wedge enabled is to engage a separation in the lockdown ring. The wedge includes a stopping feature to enable the wedge to be in one of a number of positions within the separation in the lockdown ring.

In at least one embodiment, a method for a lockdown ring to be used with a wellhead is disclosed. The method includes providing a wedge to be associated with a separation in the lockdown ring. A further step includes associating a stopping feature with the wedge. The association step is to enable the wedge to be in one of a number of positions within the separation in the lockdown ring.

BRIEF DESCRIPTION OF THE DRAWINGS

Various embodiments in accordance with the present disclosure will be described with reference to the drawings, in which.

DETAILED DESCRIPTION

Figure 1:
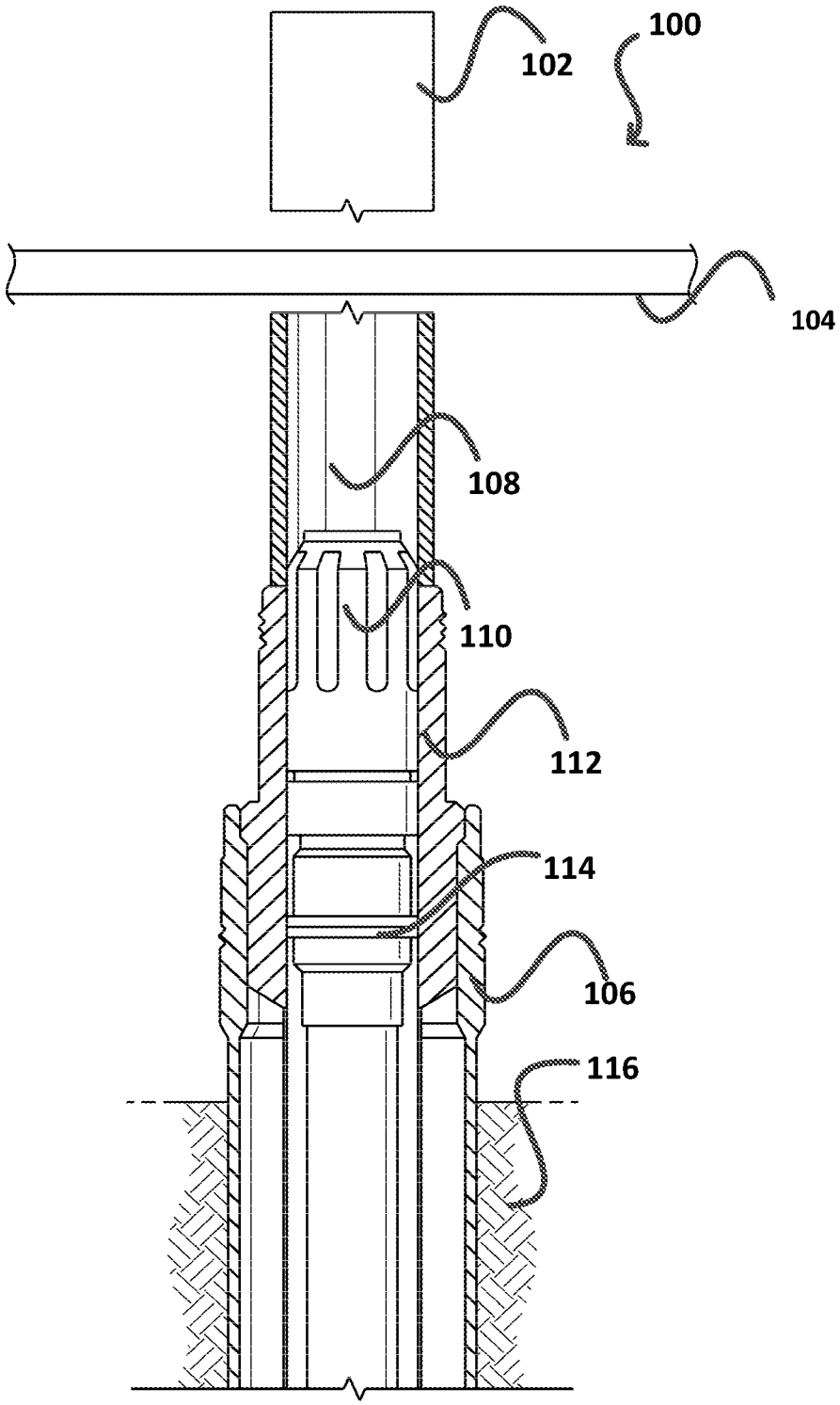
FIG. 1 illustrates an example of a wellbore with a casing hanger applied in a housing in which aspects of the present disclosure may be applied.

In the following description, various embodiments will be described. For purposes of explanation, specific configurations and details are set forth in order to provide a thorough understanding of the embodiments. However, it will also be apparent to one skilled in the art that the embodiments may be practiced without the specific details. Furthermore, well-known features may be omitted or simplified in order not to obscure the embodiment being described.

When a casing hanger is inserted into a wellhead housing, it may be difficult to line up the axial positions of the casing hanger and the wellhead housing exactly. This may be, for example, because debris in the wellbore impedes the relative positioning of the two components. As a result, when a casing or tubing hanger system is installed, there can be variation between the position of the grooves in the wellhead housing and the corresponding protrusions on the lockdown ring. To compensate for this reality, in many systems, protrusions on the lockdown ring are sized to allow play between the protrusions and the corresponding provided grooves or depressions in the wellhead housing. This simplifies installation by allowing some variance in the positions between the components, while still allowing them to engage. Problematically, however, this play may also lead to relative movement between the lockdown ring and the wellhead housing. This relative movement can become problematic when the system is under a pressure load because relative movement between the lockdown ring (and, by extension, the actuator ring and annular seal) and the wellhead housing can lead to degradation of the seal or shuttling of a hanger, which can then degrade the performance of metal-to-metal (MS) seals.

In at least one embodiment, reusable retention systems to be used with a lockdown ring for retention of features in a wellhead is described. Such a reusable retention system may be used to retain wellhead components, including hangers and seals. Self-locking taper designs for a lockdown ring and associated other rings in a reusable retention system may require tight tolerance parts. Such parts may include a lockdown ring with shallow taper in its design to then have an open split or separation in a lockdown or locking ring. A lockdown ring may include a profile that may have multiple fingers to be matched with grooves.

A wedge of at least one embodiment herein is able to function with an existing lockdown ring profile. A wedge is able to expand a lockdown ring inward and is able to fill a split in the lockdown ring. Such an inward expansion feature addresses hoop stresses that may occur because a separation or other aspects within a lockdown ring, during loading or activating of a lockdown ring as it resists movement. Such a feature also provides an alternative way of energizing a lockdown ring, in addition to using an actuator ring which may not be required.

A backing ring or other energizing ring (also referred to as an actuator or actuating ring) may be used as additional resistance to movement of in any retention system for use in a wellhead. A wedge is provided to open a split or other separation of lockdown ring by driving the separation to an open position and by providing resistance to collapse (such as, locking ability). Resistant to collapse may be achieved by the wedge providing the split lockdown ring with hoop strength. A lockdown ring having a separation may not have such hoop strength in response to radial deformation, from hoop stresses. A wedge can also address or tolerate issues relevant to circumferential stresses that are different than activation stresses of the lockdown ring. Further, a backing or other energizing ring may not be required and a lockdown ring with a wedge is able to hold a hanger locked in.

In the case of a lockdown or locking ring having a separation, including a split lockdown ring, it may be the case that a self-locking angle ring may be needed. Such a self-locking angle ring may be driven to refusal, so that it does not move further in its application and can resist movement during operation. In its position, at refusal, a self-locking angle ring may be in a condition with a lockdown ring, where a profile of the lockdown ring is so that it is fully supported and completely rigid. A self-locking lockdown ring may be considered to address locking issues using its design of shallow tapers, such as, as low as 4 degrees or lesser than 4 degrees. In at least one embodiment, such a taper of a self-locking angle ring may allow a self-locking ring to be driven out. A split lockdown ring may be used with angled fingers (such as, at about around 30-45 degrees), at its mating profile, for mating with depressions of the hanger or an inner wellhead member, may be provided to allow such insertion and also for removal.

A split lockdown ring may start with an outer diameter that is smaller than an internal diameter (ID) of a locking profile, so that it is inward based and so that it may be installed. When it is installed, it may be required to be moved more than an entire width of its locking profile and into provided grooves or depressions of an inner wellhead member. In at least one embodiment, this may be achieved by moving a lockdown ring along its shallow tapers (at its rear portion that is distinct from a taper within a separation or split of such a lockdown ring). Use of a taper in a lockdown ring itself may enable such a lockdown ring to be driven further in its locking position, but may still cause the taper ring to come lose and not support a lockdown ring fully, when it is up against applied loading.

Furthermore, any radial ring, including a corrugated ring, a flat ring, a tapered ring, or a combination of such rings may be used with a separation there between. The ring is provided with inward bias and to expand out, with the wedge causing such expansion and to hold such an expansion. The expansion is in a circumferential direction. This causes a hanger in a wellhead to be locked down, but any mandrel may be locked in this manner. When locked down, if any elevation differences exist that may be drastically different, such as a body of a mandrel in relation to a lockdown ring, then actuating the lockdown ring may be difficult. For example, if a hanger is too high, an engagement of the lockdown ring with an actuator ring may be difficult. This is also if the hanger is too high.

There may also be a displacement of the lockdown ring caused by a displacement multiplier associated with an angle, such as a 45 degree or more, of a lockdown ring as measured from a rear to a front surface of the lockdown ring. Furthermore, oilfield environment debris may also affect such actuation or cause a longer actuating range than rated for such components. A separation or slot may be milled into a lockdown ring to support the wedge described herein. Such a wedge allows locking or actuating of a lockdown ring in an intended position and over a larger range of positions. Further, local expansion of a lockdown ring is possible using the wedge.

Various other functions can be implemented within the various embodiments as well as discussed and suggested elsewhere herein.

FIG. 1 illustrates an example system 100 of a wellbore with a casing hanger applied in a housing in which aspects of the present disclosure may be applied. However, the present disclosure is not limited to example 100, as a person of ordinary skill reading the present disclosure will recognize, as the present system may be applied to other sealing systems requiring a lockdown or locking ring having an inner wellhead member, such as a hanger, and an outer wellhead member, such as a wellhead housing. In the system 100, region 116 may represent subsea or, offshore or onshore environment with the wellbore penetrating the environment for oil and gas extraction. A low-pressure wellbore housing (or outer wellhead member) 106 may include a wellhead 112, and a tubing or casing hanger (or another inner wellhead member) 114, which may be moved into place with a running tool 110.

An external wellhead supporting structure of the low-pressure wellbore housing 106 (e.g., conductor casing) supports the wellhead 112 and additional casings within the wellhead. Strings of drill pipe are provided to approach the required depth for placement and drilling. For example, running string or landing string 108 may be used to place the hanger 114 in its position in the wellhead 112. In addition, a platform 104 may be available in example 100, where equipment in module 102 is provided for power, communication, and monitoring between the wellhead 112 and external structures. In at least one embodiment, where a tubing hanger may be included for a wellhead, a similar seal structure can be included with the tubing hanger.

A person of ordinary skill reading the present disclosure would recognize that equipment in system 100 may include a power unit for providing power through the drill string into the wellbore, as well as for controlling the drilling into the wellbore. A power unit may be located near the drill string, at about the center of the platform 104. In addition, the system 100 may include a communications outpost, such as a subsea electronics module (SEM), for providing communications to other units. In addition, in subsea implementations, the platform 104 can be at the surface of the sea, while the wellhead 112 and the SEM can be located at subsea levels. The power unit may be coupled with the communications to allow for redundancy and singular cable transmission through the wellhead, while providing sufficient room for drilling via rotation of the drill string 108. FIG. 1 also illustrates that the aforementioned hangers may benefit from accurate placement of a sealing system (described below) via the present supporting structure with its axial load decoupling features.

Figure 2:
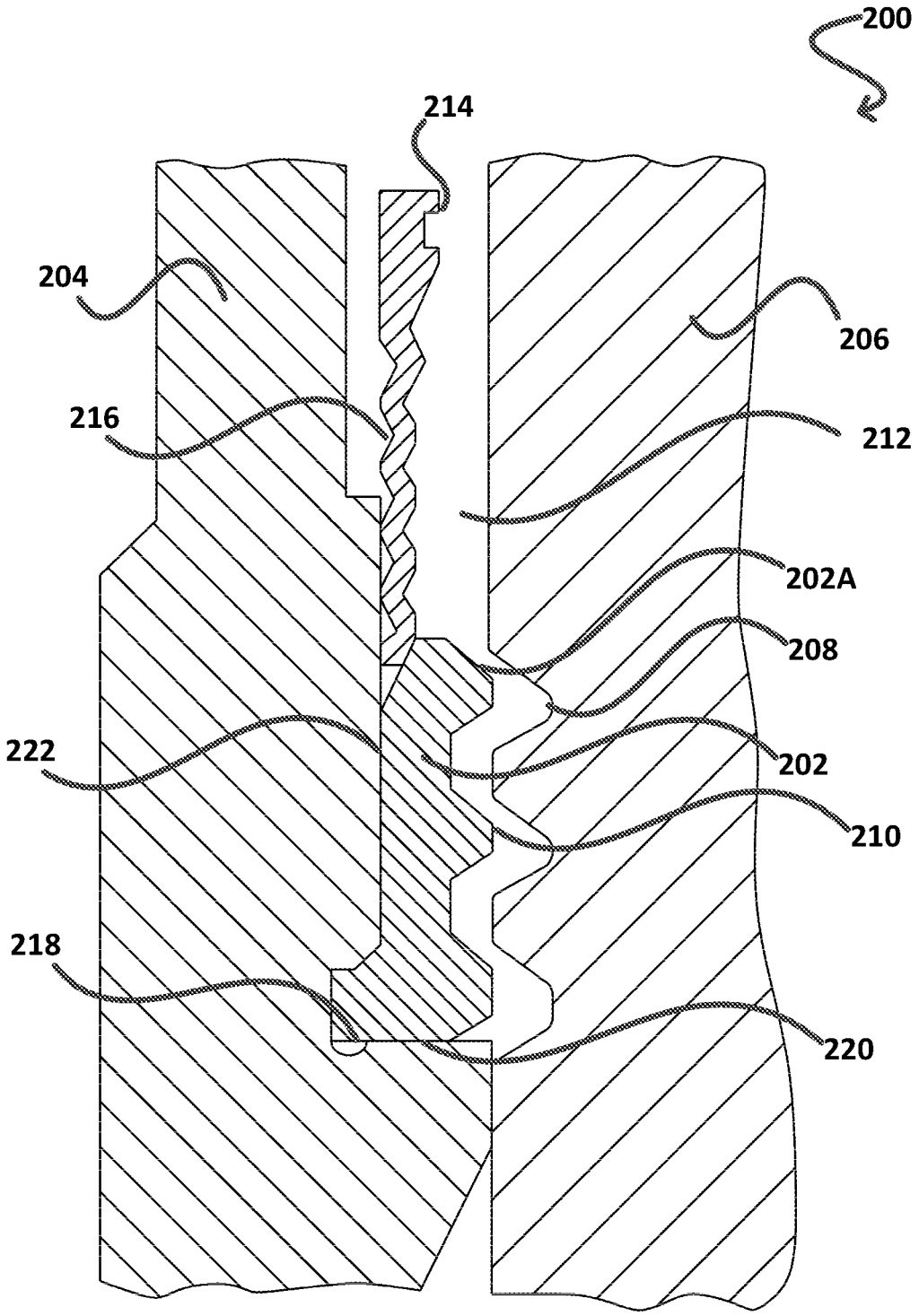
FIG. 2 illustrates an example system, in a cross-section view, that is subject to a wedge with a lockdown ring, in accordance with at least one embodiment.

FIG. 2 illustrates an example system 200, in a cross-section view, that is subject to a wedge with a lockdown ring, in accordance with at least one embodiment. A system 200 for a lockdown ring 202 to be used with a wellhead. The system 200 may be used to resist axial or vertical movement between outer wellhead member 206 and inner wellhead member 204. A housing may form an outer wellhead member 206 and a hanger may form an inner wellhead member 204. Provided grooves or depressions 208 can be located on inner diameter surface of outer wellhead member 206. Provided grooves or depressions 208 can include one or more concentric rings of indentations or channels located on the inner diameter surface of outer wellhead member 206. Each channel of provided grooves or depressions 208 can have groove flank. A groove flank can be a sloped downward facing mating shoulder.

A lockdown ring 202 may have protrusions or a mating surface which may be an opposite annular features 210 to the provided grooves or depressions 208 of the outer wellhead member 206. A lockdown ring 208 is an annular ring that can be a generally ring-shaped split member (such, as having a separation in the ring). Annular features 210 may include a locking profile that is shaped to engage provided grooves or depressions 208. A locking profile of a lockdown ring 202 can have one or more concentric ridges that are opposite in shape, in its cross-section, to a cross-sectional shape of the outer wellhead member 206 having the provided grooves or depressions 208.

A lockdown ring 202 can include an upward facing shoulder 202A on its top that is part of protrusions or a mating surface to engage at least one groove or depression 208 of the outer wellhead member 206, at its inner top. This enables a lockdown ring 202 to resist upward relative movement of the lockdown ring 202 relative to the provided grooves or depressions 208. On an opposite side 222 to the side having the protrusions or mating surface 202A, a lockdown ring 202 may have a non-profiled surface. The non-profiled surface can be a substantially smooth cylindrical surface.

Figure 3A:
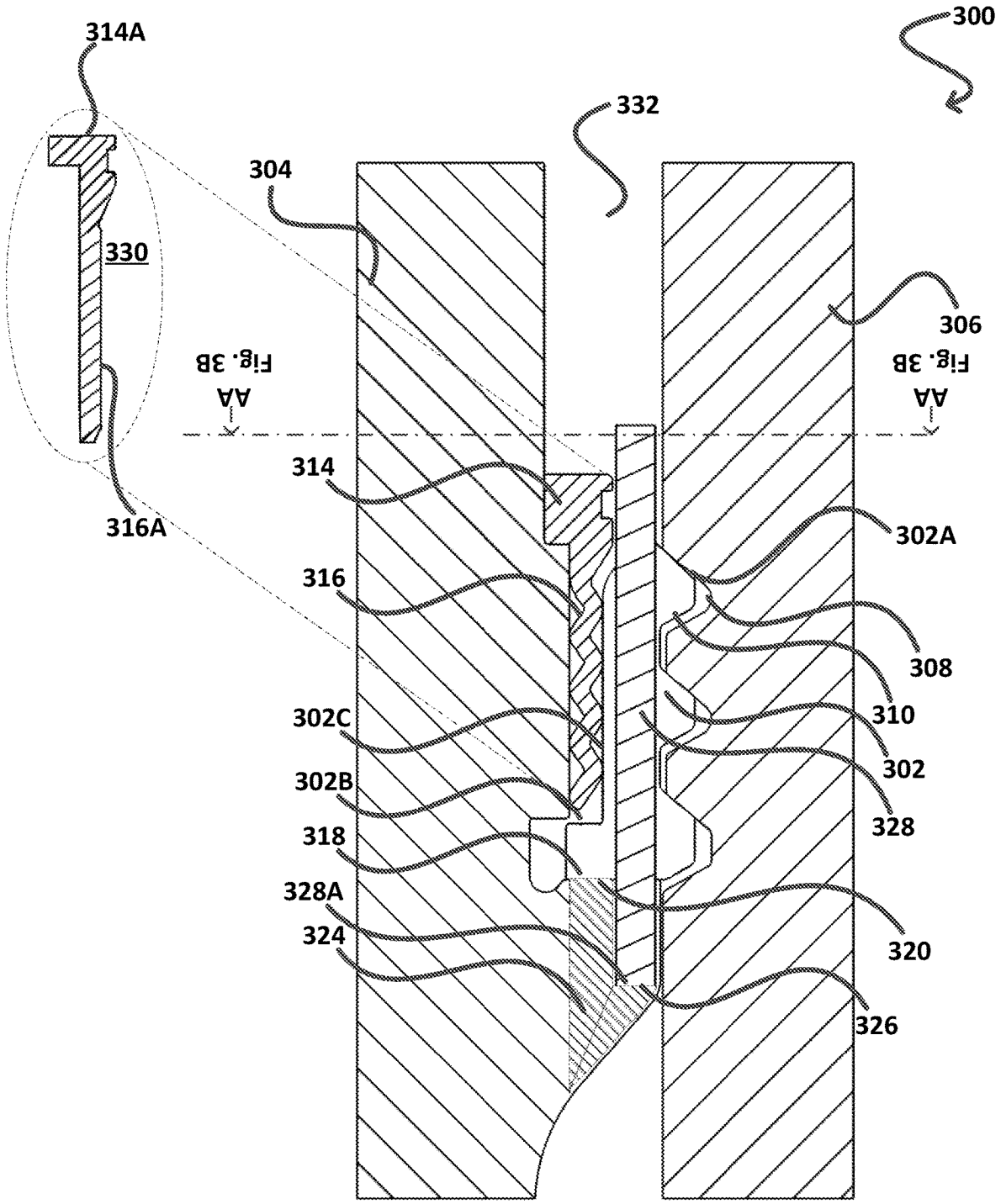
FIGS. 3A and 3B illustrate an example system, in a cross-section view and a plan view, respectively, having a wedge with a lockdown ring, in accordance with at least one embodiment.

A lockdown ring 202 can be located within annulus area 212 and supported on a shoulder 220 of an inner wellhead member 204. In at least one embodiment, a lockdown ring 202 has a lower surface 218 that is opposite its upward facing shoulder 202A. Such a lower surface 218 is to provide support for a system 200, along with the shoulder 220 of the inner wellhead member 204. A lockdown ring 202 can be radially and axially moveable between an unset position, which is as illustrated in FIG. 2, to a set position, as illustrated in FIG. 3A. When in an unset position and unless otherwise used, a wedge is fully or partly out of a separation in a lockdown ring 206, as illustrated in a callout 418 of FIG. 4 versus a set position on the bottom section of FIG. 4. Furthermore, a separation of a lockdown ring 262 in narrower in an unset position till a wedge is driven in to expand a lockdown ring 206. A full ring assembly or system having at least a lockdown ring with a wedge and a backing ring may be able to provide resistance to radial deformation (is able to address hoop stresses) to keep such a system locked in. This at least avoids sole reliance on a tapered lockdown ring or on a straight back lockdown ring which may have no adjustment features.

A lockdown ring 202 may be adapted to travel axially past provided grooves or depressions 208 without its locking profile (having protrusions 202A, 210) engaging the depressions 208. In a set position, a lockdown ring 206 is expanded, as applicable, so that its locking profile engages such provided grooves or depressions 208. As such, moving a lockdown ring 202 to an engaged or set position includes expanding a lockdown ring 202 so that its engagement with provided grooves or depressions 208 resists upward axial movement of inner wellhead member 204 relative to outer wellhead member 206. A lockdown ring 202 may include an inward bias and may be biased inward in an unset position before being caused to move outward (such as illustrated by direction markers 414 in FIG. 4) into a set position using a wedge alone or using the wedge with a backing or energizing ring 214.

Figure 3B:
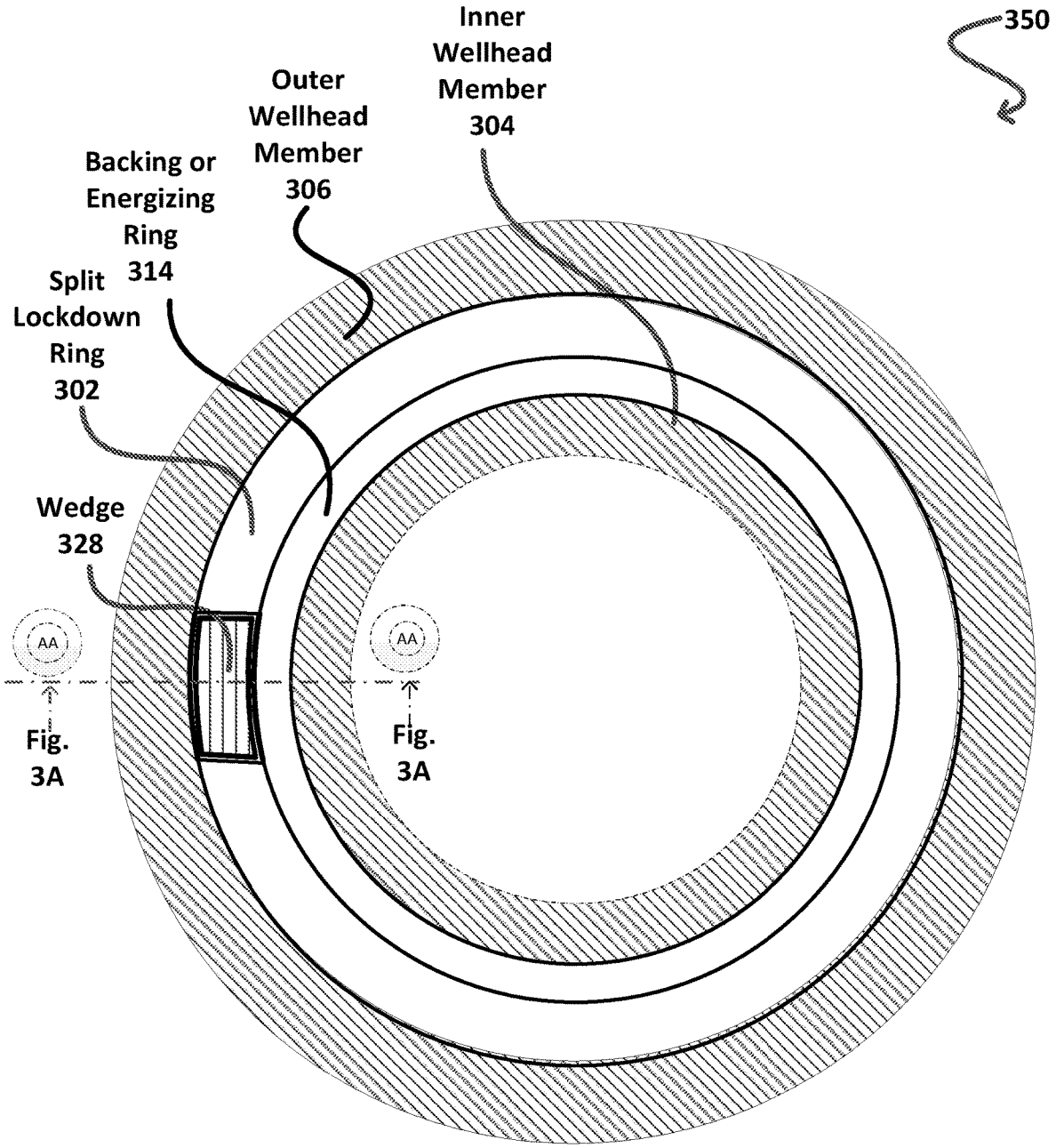

In at least one embodiment, a backing or energizing ring 214 may be used to encourage a lockdown ring 202 from an unset position to a set position. A set position may occur as a backing or an energizing ring 214 moves from an unengaged or unset position (presently illustrated in FIG. 2) to the engaged position (presently illustrated in FIGS. 3A and 3B with a wedge in place). A backing or energizing ring 214 can have an engaging portion 216 that may be a corrugated shape in cross section. When a backing or energizing ring 214 is in the engaged position, an end of energizing ring can engage annular stop shoulder of a lockdown ring (as illustrated with respect to FIG. 4). In at least one embodiment, a backing or energizing ring 214 may or may not have corrugated shapes 216. For example, an engaging portion 216 may be a smooth surface, as illustrated in callout 330 in FIG. 3A.

A shoulder (such as, illustrated reference numeral 302B in FIG. 3A) of a lockdown ring 202 provides a positive stop for a backing or energizing ring 214. In at least one embodiment, such a shoulder may be provided independent of a lockdown ring 202. In at least one embodiment, such a shoulder can be an annular shoulder separate from a lockdown ring. A backing or energizing ring 214 can also have a tool profile for mating with an installation tool that may be used to place the backing or energizing ring 214 or to place other rings within an annular area 212 within wellhead system 200. Such an installation tool may be also used for moving an energizing ring 214 between engaged and unengaged positions. In at least one embodiment, when a backing or energizing ring is in a set position, such a ring is fit between a non-profiled surface of lockdown ring and an outer diameter surface of inner wellhead member 204. In at least one embodiment, a non-profiled surface of a lockdown ring is an inner diameter surface of lockdown ring.

In at least one embodiment, a system 200 that is a reusable retention system may be used for sealing between a wellhead housing and a hanger. However, such a system 200 may be used with hangers, seals, and plugs as well. Such a system may include multiple lockdown rings, backing (or energizing) rings, and wedges. Such multiple features may be provided in opposite directions, such as with a first lockdown ring against a housing in one part of a sealing system and with a second lockdown ring against a hanger in another part of the same sealing system. A fit between such multiple features may provide strength to retain lockdown ring in a set position for the sealing system or for part of the sealing system. Such a fit can retain an energizing ring in an engaged position without the use of an additional locking member, even during ongoing long-term operation of the wellhead assembly or system.

In at least one embodiment, a corrugated shape of an engaging portion 216 of a backing or an energizing ring (such as, in its cross section) can be formed of concentric ridges and valleys. Such a corrugated shape of an engaging portion of an energizing ring can follow a helical pattern. For radial stiffness of a corrugated shape of engaging portion 216 to be generally constant over a diameter (or length) of the corrugated shape of the engaging portion 216, and for the radial stiffness to remain generally constant over a range of radial gaps, a pattern of concentric ridges and valleys is provided, along with a wedge to enable further hoop strength for such a ring having a separation therebetween.

In view of manufacturing tolerances, an exact final axial location of an inner wellhead member relative to outer wellhead member may be uncertain. A locking profile of lockdown ring 202 and provided grooves or depressions 208 can be designed to allow a lockdown ring 202 to resist axial or vertical movement of inner wellhead member 204 relative to outer wellhead member 206 over a range of relative positions. A stack-up tolerance range is a distance through which a bottom of a lockdown ring that may have a split or separation can be located and can still provide a required locking capacity.

In at least one embodiment, as a lockdown ring has a flank, shoulder, or protrusion 202A and a corresponding depression or flank 208 include sloped surfaces. An extent of radial engagement of a lockdown ring 202 within provided grooves or depressions 208 when lockdown ring is in a set position may depend on a final axial location of an inner wellhead member relative to an outer wellhead member. When multiple lockdown rings are used, with one facing a hanger and another facing a housing, a lower lockdown ring may be in a set position and may have a tolerance allowance, which is an axial distance over which an inner wellhead member could have been located with an upper lockdown ring still being capable of being in a set position to restrict axial movement of inner wellhead member relative to outer wellhead member.

An engaging portion 216 of a backing or an energizing ring 214 can be shaped so that if radial gap is a minimum value a setting load is not excessive, yet when a radial gap is a maximum value, a radial stiffness of an engaging portion of an energizing ring may be sufficient to retain a lockdown ring in a set position. This is also so that an energizing ring can be retained in an engaged position. A thickness of material used to form a corrugated cross section of an engaging portion of an energizing ring, as well as a number of corrugations, an angle of such corrugations (as seen in a section profile), a shape of such corrugations (as seen in a section profile), and other parameters of a corrugated section (engaging portion) may be selected to meet performance requirements for locking down inner or outer wellhead members of a particular wellhead assembly or system.

Provided grooves or depressions 208 are illustrated as located on an inner diameter surface of outer wellhead member 206 and a lockdown ring 202 is illustrated as being biased radially inwards and pushed radially outward with a backing or an energizing ring 214. This bias may be used with multiple such systems in an area within a wellhead and a hanger, for instance, to occur simultaneously or subsequently in a seal arrangement having multiple lockdown rings, multiple backing or energizing rings, and multiple wedges.

FIG. 3A illustrates an example system 300, 350, in a cross-section view, having a wedge 328 with a lockdown ring 302, in accordance with at least one embodiment. Here a set position is shown for a wedge 328 and for an associated lockdown ring 302 and backing or actuator ring 314. In FIG. 3A, provided grooves or depressions 308 is located on an inner diameter surface of an outer wellhead member 306. A lockdown ring 302 is supported on annular shoulder 320 that is part of seal or plug assembly or any pertinent reusable retention system, and may be part of an outer wellhead member 306. A lockdown ring 302 here may be biased radially inward and moving a lockdown ring 302 to an engaged position may include collapsing a lockdown ring 302 so that an engagement of its locking profile including protrusions 302A with provided grooves or depressions 308 does not occur till it is in the right position. Then the lockdown ring may be caused to expand outwards and can assist in resisting upward axial movement of any of such rings, relative to inner wellhead member 304.

When a backing ring or an energizing ring 314 is in an engaged or set position, an end of such a backing or an energizing ring 314 may engage a shoulder 302B that is an annular shoulder and that may be part of seal assembly or system, such as on an opposite side of a top shoulder or surface 302A of a lockdown ring 302 and opposite to a side having protrusions (such as aspect 310 in FIG. 3A). When a backing or an energizing ring 314 is in a set position, there may be a fit between a non-profiled surface 302C of a lockdown ring 302 and an outer diameter surface of a backing or energizing ring 314. Furthermore, a backing or energizing ring 314 may not have corrugations and may have a smooth surface 316A as illustrated in an example energizing ring 314A of a callout 330 at the top of FIG. 3A.

In at least one embodiment, a non-profiled surface of a lockdown ring 302 is an inner diameter surface of lockdown ring 302. In at least one embodiment, a radial width of an engaging portion of a backing ring or an energizing ring 314 may be measured from a peak on one side of engaging portion (having corrugations) to another peak on an opposite side of an engaging portion that is greater than a radial gap between a non-profiled surface of a lockdown ring 302 and an inner diameter surface of seal assembly or system when a lockdown ring 302 is in a set position. However, when a non-profiled backing ring or an energizing ring 314A is used, a radial width may be simply from one side to another side of its non-profiled surfaces 316A. Such information is useful in determining an appropriate backing ring or an energizing ring 314; 314A to be used in a system 300.

In operation, a first and a second, or inner and an outer wellhead members 304, 306 may be provided to be used as part of a wellhead assembly or system 300. In at least one embodiment, a wellhead assembly or system 300 does not need features in an inner or an outer wellhead members. In at least one embodiment, a lockdown ring 302 can be supported by, and carried into wellhead assembly, on an annular shoulder of one or such seal members. In at least one embodiment, a backing ring or an energizing ring 314; 314A may be moved axially within an annulus area 332 between such inner and outer wellhead members 304, 306, and between an unengaged position and an engaged position (whereas an engaged or set position is illustrated in FIG. 3A for a wedge, a lockdown ring, and a backing or energizing ring). Prior to an engaged or set position, a backing ring or an energizing ring 314; 314A may be moved within an annulus area 332 with a downhole tool. When a backing ring or an energizing ring 314 is in an engaged position, a lockdown ring 302 may be in a set position.

A lockdown ring 302 may be biased radially inward and movable to an engaged position by first collapsing the ring and then causing it to expand. Such movement includes causing a lockdown ring 302 to be moved to a position for engagement, then causing it to be moved radially outward either by bias or encouraged using a backing ring or an energizing ring 314, to then engage provided grooves or depressions 308 on an inner diameter surface of an outer wellhead member 306. A lockdown ring 302 may be caused to be set or engaged by pushing a backing ring or an energizing ring 314 along a non-profiled surface of the lockdown ring 302. Such a non-profiled surface may be an inner diameter surface of a lockdown ring 302. However, a backing ring or an energizing ring 314 may not be required with a wedge set into a lockdown ring.

Figure 4:
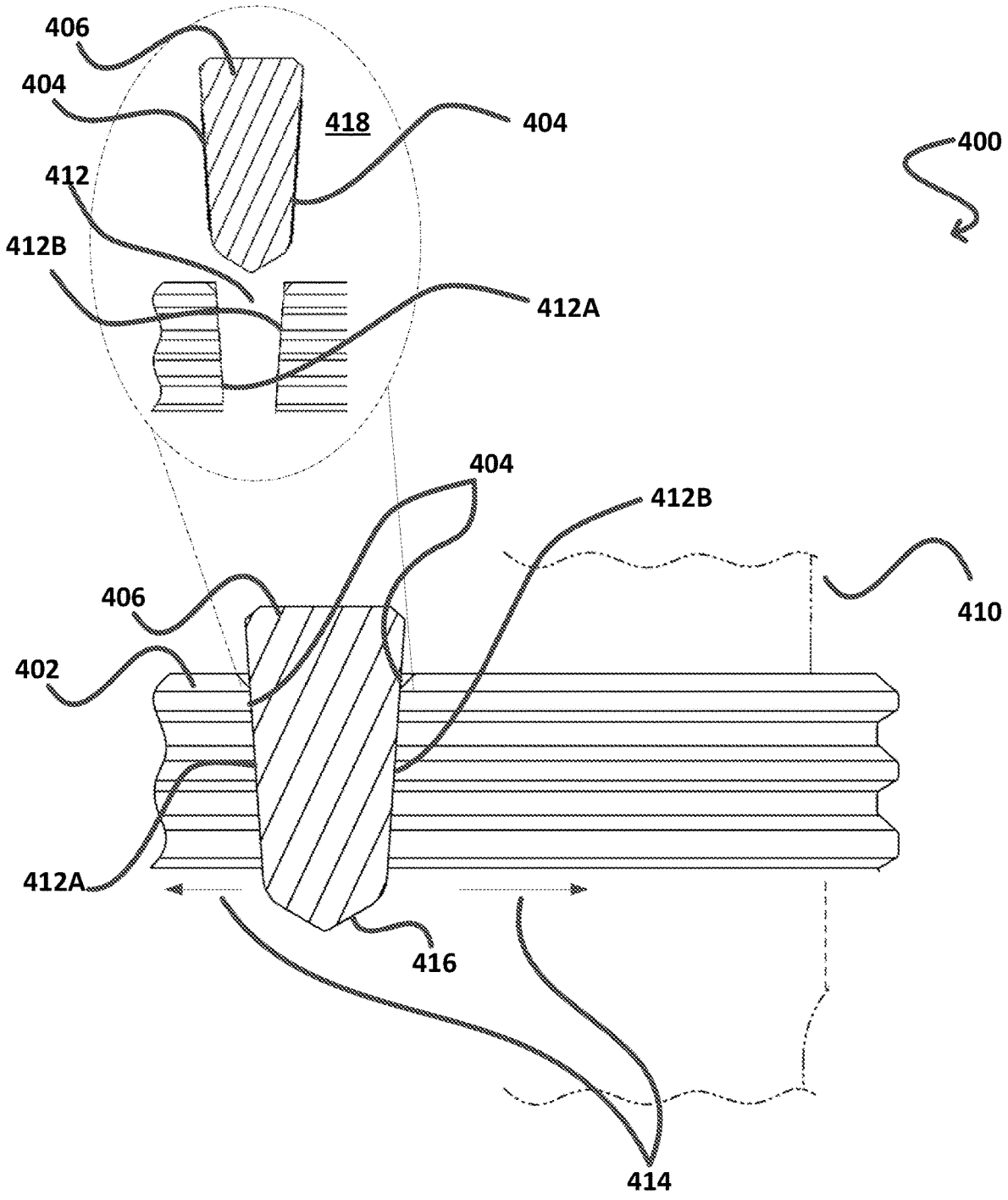
FIG. 4 illustrates an example system, in a side view, having a wedge with a lockdown ring, in accordance with at least one embodiment.

The system 300 includes a wedge 328 that may be associated with a separation (such as aspect 412 in FIG. 4)

in a lockdown ring 302. A stopping feature 328A may be associated with a wedge 328 to enable such a wedge 328 to be in one of multiple positions as it is driven in the separation available within a lockdown ring 302. Once the stopping feature 328A encounters a shoulder 326 of the wellhead member 304 (that may be integral or and associated feature thereof), a wedge may not move further.

As such, a lockdown ring 302 may engage a housing (an outer wellhead member) 306 using its protrusions 310 against corresponding depressions 308 on the outer wellhead member 306. A wellhead member 304 may be an inner wellhead member and may have a shoulder 326 to provide a stopping feature for the wedge 328. Even though shown in different shading, such a shoulder 326 may be an integrated part of a wellhead member 304 or may be part of a component 324 fixedly or removably provided for a wellhead member 304.

A system 300 may include a backing ring or an energizing ring 314 that has corrugations 316 to energize or activate a lockdown ring 302. However, a system 300 need not have a backing ring or energizing ring 314. As such, a lockdown ring 302 may be biased inward, so that it can hold its position when not engaged and so that a wedge 328 can sufficiently help it expand and to hold a set or engaged position relative to both wellhead members 304, 306. Further, a backing ring or energizing ring 314A without corrugations and having a smooth surface 316A may be used instead. Teeth or protrusions 302A, 310 of a lockdown ring 302 may be received into depressions 308 of a wellhead member 306.

Such a system 300 may be an MS seal having a lockdown ring 302, a wedge 328, and a backing ring or energizing ring 314, as illustrated in a set position with a flank, a shoulder, or a top-most protrusion 302A having a sloped surface that abuts a corresponding sloping surface of a depression 308 of a wellhead member 306. In at least one embodiment, a lockdown ring 302 rests a bottom surface 318 against a shoulder 320 of a wellhead member 304, which may be an inner wellhead member depending on a seal configuration or application. As such, an integrated or provided portion 324 of a wellhead member 304 may have two shoulders 320, 326, with one shoulder 326 acting as a stopping feature for a bottom surface 328A of a wedge 328.

FIG. 4 illustrates an example system 400, in a side view, having a wedge with a lockdown ring 402, in accordance with at least one embodiment. The wedge engages or sets within separation 412 of a lockdown ring 402 with sides 412A, B of the separation physically contacting sides 404 of the wedge 406. Such a wedge 406 may have different widths and different tapper angles to enable different circumferential applications for a lockdown ring 402. In at least one embodiment, a wedge 406 and separations 412 within a lockdown ring 402 may not have angles and may be a straight wedge to engage a straight ends (as seen from a section view) of a separation in a lockdown ring 402. In at least one embodiment, a wedge 406 may have one or more sides 404 having one or more locking features thereon (such as illustrated in and described with respect to at least FIGS. 5A and 5B).

A bottom surface 416 of a wedge 406 may also form part of a stopping feature. A bottom surface 416 of a wedge 406 may have a different shape than illustrated, with different areas of the bottom surface 416 being part of a stopping feature along with a wellhead member, such as illustrated in FIG. 3. As such, a bottom surface 416 of such a wedge 406 may be fully contacting a shoulder (such as a shoulder 326 of a wellhead member 304 in FIG. 3A) or may be partly contacting a shoulder such that is can sustain refusal to further drive from a setting action for the wedge 406.

A system 400 also illustrates that a wedge 406 can provide circumferential continuity along outward paths 414 for a lockdown ring. Such outward paths 414 also represent directions of movement of a lockdown ring 402 having an inward bias. Such circumferential continuity can address hoop stress of a lockdown ring in an application in a wellhead. For example, such a circumferential continuity provides hoop strength in a circumferential direction for a lockdown ring. In at least one embodiment, a wedge 406 can include a first thickness that is within a threshold of a second thickness of a lockdown ring to enable such circumferential continuity. For example, a wedge 406 expands a separation in a lockdown ring 402 in a circumferential direction but is able to assist lockdown ring 406 in retaining a strength within the lockdown ring 402 as circumferential load may be shared through the wedge 406.

A system 400 as illustrated in FIG. 4 also has a backing ring or energizing ring illustrated in a cross-sectional feature (such as in FIG. 3A), although a person of skill in the art would recognize that such a backing ring or energizing ring is circumferential around a wedge and around a lockdown ring. In at least one embodiment, an inner wellhead member 410 is illustrated, to which a lockdown ring 402 is associated by activation or energizing of a backing ring or energizing ring. As such, a separation or split between ends 412A, B of a lockdown ring 402 enables a wedge to be inserted in place and to address hoop stress for a lockdown ring 402.

Figure 5A:
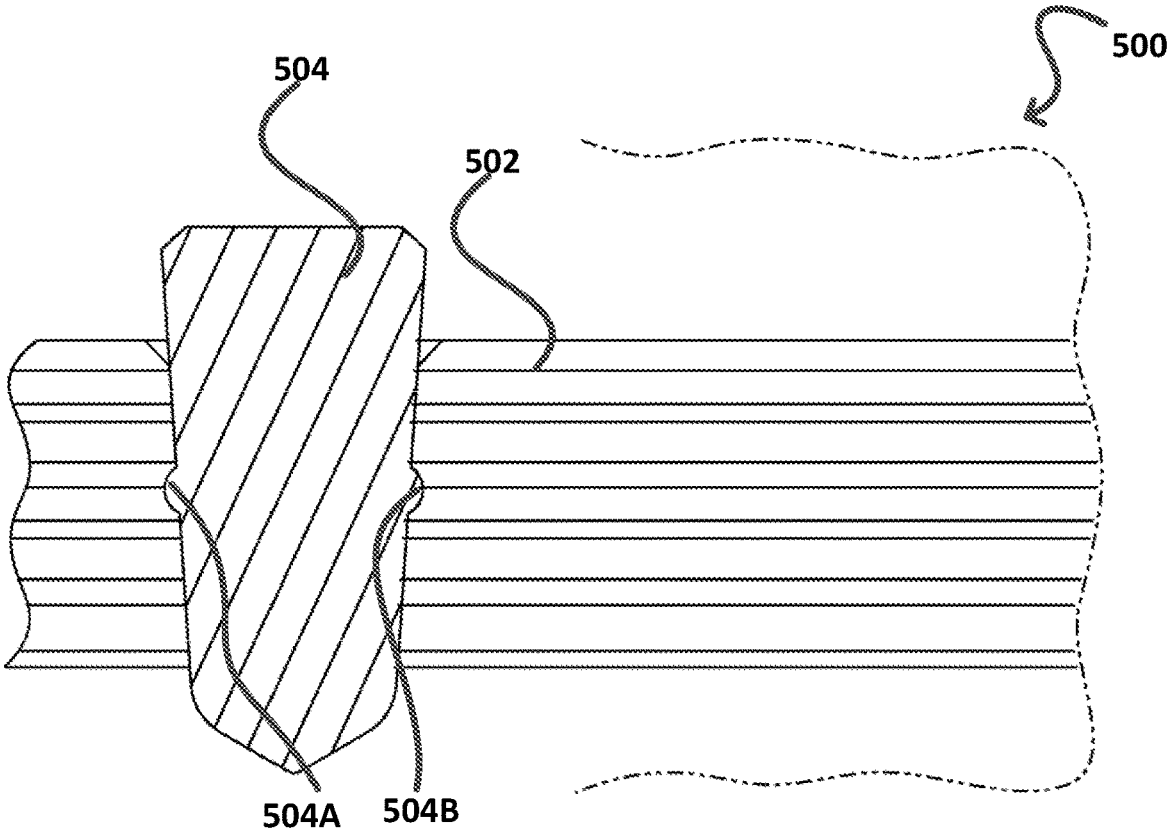
FIGS. 5A and 5B illustrate an example system, in a side views, of different locking features for a wedge to be used with a lockdown ring, in accordance with at least one embodiment.
Figure 5B:
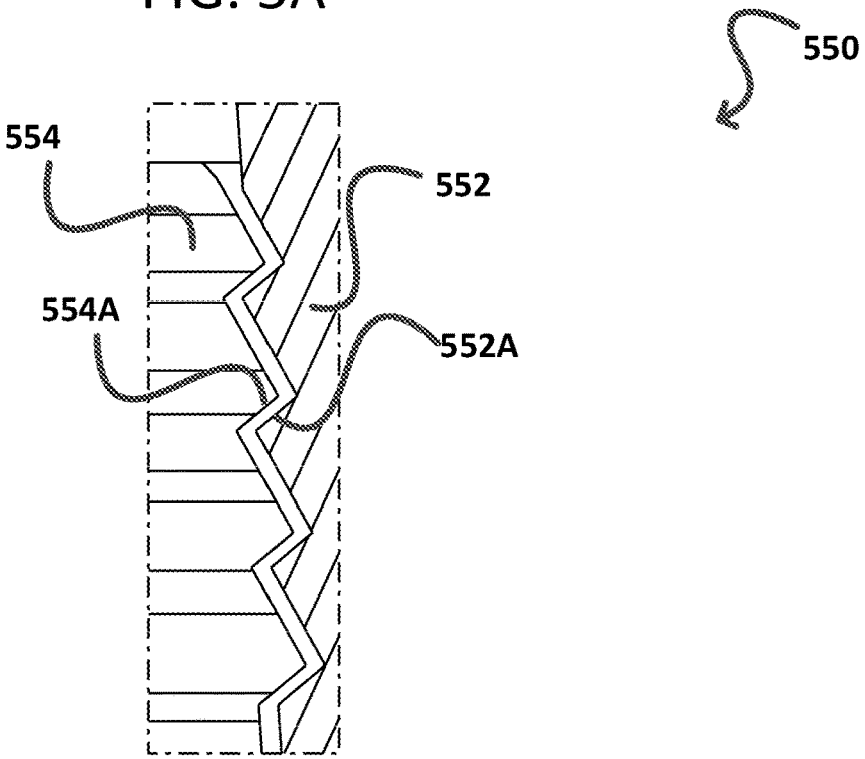

FIGS. 5A, 5B illustrate an example system 500; 550, in a side views, of different locking features 504A, 504B, 554A, 554B for a wedge 504 to be used with a lockdown ring 502, in accordance with at least one embodiment. For example, one or more sides of a wedge 504 may include one or more bumps 504A, B on its sides (such as sides 404 of FIG. 4), forming locking features, to engage at least one corresponding depression or feature of a separation (such as in sides 412A, B in FIG. 4) in a lockdown ring. A side, such as one or more ends or sides 412A, B (in FIG. 4) of a lockdown ring 502, may have depressions to receive such one or more bumps 504 in a wedge.

Such features ensure that a wedge 504 then remains in position before or after a lockdown ring 502 is energized or moved into its set position and after a stopping feature is engaged, as illustrated in and described with respect to FIGS. 3 and 4. FIG. 5B illustrates that such one or more sides or ends (such as sides 412A, B in FIG. 4) of a lockdown ring 554 may have second ratchet features 554A. A wedge 552 has one or more first ratchet features 552A on one or more sides (such as sides 404 of FIG. 4). The one or more first ratchet features 552A can engage at least one second ratchet feature 554A of a side of a separation in a lockdown ring, so that it may be kept in place while a lockdown ring is energized or activated to a set position or after a lockdown ring is energized or activated to a set position. As such, a wedge can proceed till a final position (till refusal) where its bottom surface is resting on a shoulder of a lockdown ring or of a hanger, a different ring, or a housing; and a locking feature can ensure that such a wedge 504 is locked in the final position.

Figure 6:
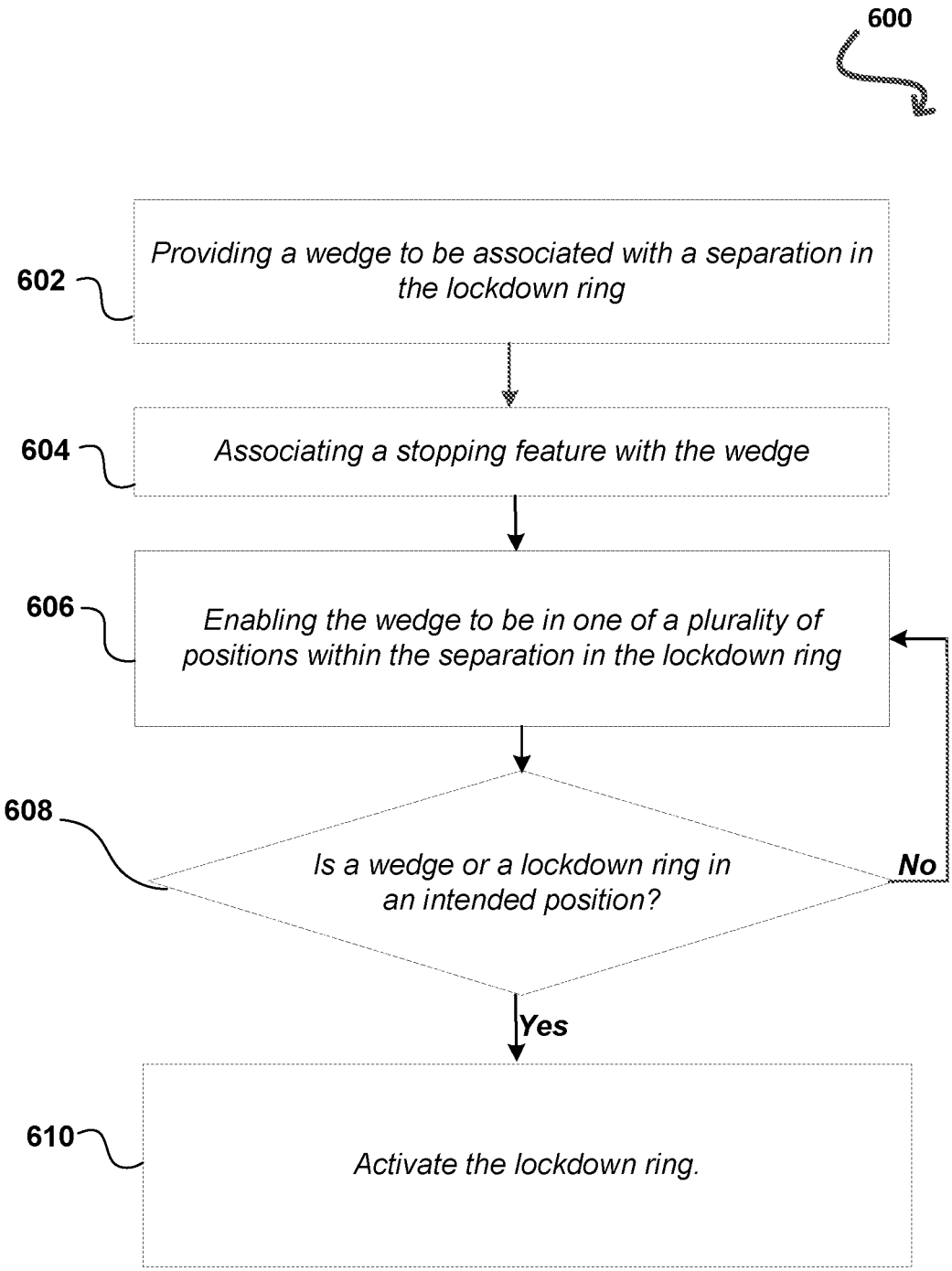
FIG. 6 illustrates a process flow for an example system having a wedge with a lockdown ring as described with respect to one or more of FIGS. 1-5B, in accordance with at least one embodiment.

FIG. 6 illustrates a process flow 600 for an example system having a wedge with a lockdown ring as described with respect to one or more of FIGS. 1-5B, in accordance with at least one embodiment. The method includes a sub-process 602 for providing a wedge to be associated with a separation in a lockdown ring. Sub-process 604 is for associating a stopping feature with a wedge. In at least one embodiment, such an association may be by engineering stopping features, such as one or more of: bumps, ratchets, or shoulders for one or more components of a sealing assembly or system. In at least one embodiment, such an association may be by providing a wedge in position in a separation and to be driven into such a separation in a lockdown ring.

Sub-process 606 is to enable a wedge to be in one of a plurality of positions within a separation in a lockdown ring. In at least one embodiment, a wedge is fully inserted through multiple positions till refusal, at which point it achieves an intended hoop separation within a lockdown ring. In at least one embodiment, this may be related to a diameter of an application of a lockdown ring. Such features enable a lockdown ring to be used in multiple applications of differing diameters and at different positions, with its profiled side against a housing.

Sub-process 608 is for determining that an intended position is reached for a wedge or a lockdown ring. For example, both a wedge and a lockdown ring may be continually adjusted till an appropriate position is reached for one or more of both components. That is, when a refusal is met or when a locking feature has locked the wedge in position. However, a wedge may be first adjusted followed by driving or energizing of a lockdown ring. Alternatively, a wedge may be adjusted after driving or energizing of a lockdown ring has been completed. As such one or more of the sub-processes or steps 602-610 of method 600 may be performed in a different order than described Sub-process 610 may include an activating or energizing step for a lockdown ring. In at least one embodiment, aspects of sub-process 610 may occur with sub-process 606, and a determination in sub-process 608 enables a method 600, as described, to conclude positioning of a wedge. Sub-process or step 606 may be repeated if an intended position is not reached for a wedge or a lockdown ring. A further sub-process or step of method 600 includes providing a wellhead member having a shoulder to act as the stopping feature for the wedge.

A further sub-process or step of method 600 includes activating 610 a lockdown ring using a backing ring. Sub-process 610 may be performed before sub-processes 606 and 608. Then protrusions of a lockdown ring may be received into depressions of a wellhead member. A further sub-process or step of method 600 includes enabling a wedge to include different widths and different angles. Such different widths or different angles can enable different circumferential applications for a lockdown ring. A further sub-process or step of method 600 includes enabling a wedge to include one or more sides having one or more bumps thereon. Such one or more bumps can engage at least one depression of a separation in a lockdown ring.

A further sub-process or step of method 600 includes enabling a wedge to have one or more first ratchet features on one or more sides thereof. Such one or more first ratchet features can engage at least one second ratchet feature of a separation in a lockdown ring. A further sub-process or step of method 600 includes providing, using a wedge, circumferential continuity to a lockdown ring. Such circumferential continuity can address loss of hoop strength (or hoop stress at least partly from the separation) of a lockdown ring in an application in a wellhead. A further sub-process or step of method 600 includes enabling a wedge to include a first thickness that is within a threshold of a second thickness of a lockdown ring so that continuity in stresses may be achieved.

The specification and drawings are, accordingly, to be regarded in an illustrative rather than a restrictive sense. It will, however, be evident that various modifications and changes may be made thereunto without departing from the broader spirit and scope of the invention as set forth in the claims. Further, any of the many embodiments disclosed here may be combined by a person of ordinary skill using the present disclosure to understand the effects of such combinations.

What is claimed is:

1. A system for a lockdown ring used with a wellhead, the system comprising:

a wedge inserted within a split that breaks continuity in a circumference in the lockdown ring to cause the lockdown ring to be expanded from an unset or disengaged position, between a first wellhead member and a second wellhead member, to an engaged position with the first wellhead member, relative to the second wellhead member, of the wellhead, wherein the engaged position supports energizing or locking of the first wellhead member relative to the second wellhead member; and a stopping feature associated with the wedge to enable the wedge to be in one of a plurality of engaging positions that includes the engaged position within the split in the lockdown ring.

2. The system of claim 1, further comprising:

a shoulder of the second wellhead member or a further wellhead member to contact the stopping feature associated with the wedge.

3. The system of claim 1, further comprising:

a backing ring to activate the lockdown ring, wherein protrusions of the lockdown ring are to be received into depressions of the first wellhead member in the expanded position of the lockdown ring.

4. The system of claim 1, further comprising:

the wedge having different widths or taper angles to enable different circumferential applications for the lockdown ring.

5. The system of claim 1, further comprising:

the wedge having one or more sides, the one or more sides to comprise a locking feature to engage at least one corresponding feature of the split in the lockdown ring so that the wedge is enabled to be locked in one of the plurality of engaging positions.

6. The system of claim 1, further comprising:

the wedge comprising one or more first ratchet features on one or more sides thereof, the one or more first ratchet features to engage at least one second ratchet feature of the split in the lockdown ring.

7. The system of claim 1, wherein the wedge is further to increase hoop strength that has reduced, in part, due to the break in the continuity in the circumference of the lockdown ring in an application in the wellhead.

8. The system of claim 1, further comprising:

the wedge to comprise a first thickness that is within a threshold of a second thickness of the lockdown ring.

9. A wedge inserted within a split that breaks continuity in a circumference in a lockdown ring of a wellhead, wherein the lockdown ring is expanded by the wedge from an unset or disengaged position, between a first wellhead member and a second wellhead member, to an engaged position with the first wellhead member relative to the second wellhead member, wherein the engaged position supports energizing or locking of the first wellhead member relative to the second wellhead member, and wherein a stopping feature of the wedge enables the wedge to be in one of a plurality of positions that includes the engaged position within the split in the lockdown ring.

10. The wedge of claim 9, further comprising: different widths or taper angles to enable different circumferential applications for the lockdown ring.

11. The wedge of claim 9, further comprising: one or more sides having one or more bumps to engage at least one depression of the split in the lockdown ring.

12. The wedge of claim 9, further comprising: one or more sides having one or more first ratchet features thereon, the one or more first ratchet features to engage at least one second ratchet feature of the split in the lockdown ring.

13. A method for a lockdown ring used with a wellhead, the method comprising:

providing a wedge inserted within a split that breaks continuity in a circumference in the lockdown ring to cause the lockdown ring to be expanded from an unset or disengaged position, between a first wellhead member and a second wellhead member, to an engaged position with the first wellhead member, relative to the second wellhead member, of the wellhead, wherein the engaged position supports energizing or locking of the first wellhead member relative to the second wellhead member; and associating a stopping feature with the wedge to enable the wedge to be in one of a plurality of positions that includes the engaged position within the split in the lockdown ring.

14. The method of claim 13, further comprising:

providing a shoulder of the second wellhead member or a further wellhead member to contact the stopping feature associated with the wedge.

15. The method of claim 13, further comprising:

activating the lockdown ring using a backing ring, wherein protrusions of the lockdown ring are to be received into depressions of the first wellhead member in the expanded position of the lockdown ring.

16. The method of claim 13, further comprising:

enabling the wedge to comprise different widths or different taper angles to enable different circumferential applications for the lockdown ring.

17. The method of claim 13, further comprising:

enabling the wedge to comprise one or more sides, the one or more sides to comprise a locking feature to engage at least one corresponding feature of the split in the lockdown ring so that the wedge is enabled to be locked in one of the plurality of positions.

18. The method of claim 13, further comprising:

enabling the wedge to comprise one or more first ratchet features on one or more sides thereof, the one or more first ratchet features to engage at least one second ratchet feature of the split in the lockdown ring.

19. The method of claim 13, further comprising:

providing, using the wedge, an increase in hoop strength in the lockdown ring, the hoop strength having reduced, in part, due to the break in the continuity in the circumference of the lockdown ring, in an application in the wellhead.

20. The method of claim 13, further comprising:

enabling the wedge to comprise a first thickness that is within a threshold of a second thickness of the lockdown ring.

* * * * *